US009171529B2

(12) United States Patent
Rukavina

(10) Patent No.: US 9,171,529 B2
(45) Date of Patent: Oct. 27, 2015

(54) TREMOLO DEVICE

(75) Inventor: Tony Rukavina, Coquitlam (CA)

(73) Assignee: Ruktek Design and Machining, Coquitlam, British Columbia (CA)

( * ) Notice: Subject to any disclaimer, the term of this patent is extended or adjusted under 35 U.S.C. 154(b) by 516 days.

(21) Appl. No.: 13/579,609

(22) PCT Filed: Feb. 17, 2011

(86) PCT No.: PCT/CA2011/000186

§ 371 (c)(1),
(2), (4) Date: Nov. 5, 2012

(87) PCT Pub. No.: WO2011/100828

PCT Pub. Date: Aug. 25, 2011

(65) Prior Publication Data

US 2013/0047816 A1 Feb. 28, 2013

(30) Foreign Application Priority Data

Feb. 18, 2010 (CA) ..... 2693684

(51) Int. Cl.
*G10D 3/14* (2006.01)

(52) U.S. Cl.
CPC ..... *G10D 3/146* (2013.01)

(58) Field of Classification Search
CPC ..... G10D 3/14; G10D 3/143; G10D 3/04; G10D 3/146
USPC ..... 84/312 R, 313
See application file for complete search history.

(56) References Cited

U.S. PATENT DOCUMENTS

| | | | | | |
|---|---|---|---|---|---|
| 2,741,146 | A | | 4/1956 | Fender | |
| 4,171,661 | A | | 10/1979 | Rose | |
| 4,632,004 | A | | 12/1986 | Steinberg | |
| 4,742,750 | A | | 5/1988 | Storey | |
| 4,903,568 | A | | 2/1990 | Itoh | |
| 4,984,493 | A | | 1/1991 | Schaller | |
| 5,088,374 | A | | 2/1992 | Saijo | |
| 5,419,227 | A | * | 5/1995 | Lavineway | 84/313 |
| 5,880,383 | A | * | 3/1999 | Huff | 84/313 |
| 6,015,945 | A | | 1/2000 | Borisoff | |
| 6,143,967 | A | * | 11/2000 | Smith et al. | 84/313 |
| 6,300,550 | B1 | | 10/2001 | Smith | |

OTHER PUBLICATIONS

International Search Report for application No. PCT/CA2011/000186 dated Jun. 3, 2011.

* cited by examiner

*Primary Examiner* — Kimberly Lockett
(74) *Attorney, Agent, or Firm* — Gardner Groff Greenwald & Villanueva, PC

(57) ABSTRACT

A tremolo device is provided. The tremolo device has a base plate with a leading edge that comprises a bearing surface. The base plate also comprises a bracket for attachment of a lever. The tremolo device also includes a pivot rail comprising a pivot bearing surface that matingly engages the bearing surface of the leading edge. When matingly engaged, the bearing surface of the leading edge and the pivot bearing surface defines 3 or more contact surfaces having a length of from about 20% to about 100% of the length of the leading edge.

15 Claims, 7 Drawing Sheets

TREMOLO DEVICE

IN THE CROSS-REFERENCE TO RELATED APPLICATIONS

This application is a U.S. national phase application under 35 USC 371 of international application number PCT/CA2011/000186, filed Feb. 17, 2011, which claims priority to Canadian Application No. 2,693,684, filed Feb. 18, 2010, which is hereby incorporated herein by reference in its entirety for all purposes.

TECHNICAL FIELD

The present disclosure relates to a tremolo device for a stringed instrument. More particularly, the disclosure relates to a tremolo device for a guitar.

BACKGROUND

It has long been known to equip guitars and other stringed musical instruments with a tremolo. The tremolo enables the instrument player to change the tension in the strings when desired, and thereby change the sound of the guitar.

U.S. Pat. No. 2,741,146 discloses a tremolo for use with a guitar. The tremolo comprises a base plate attached to a bar that extends within a cavity in the body of the guitar. The bar is attached at its lower end by springs to an anchor within the cavity. A leading edge of the base plate is beveled to form a fulcrum ridge, and the plate is loosely attached to the guitar body using a plurality of screws linearly disposed along the fulcrum ridge. With this arrangement, the base plate may pivot about a fulcrum defined by the screws. A lever arm is attached to one side of the base plate. As a player presses down on the lever arm the spring-biased base plate pivots forward, stretching the springs, and reducing the string tension causing the pitch of the guitar strings to decrease or "go flat". When the player releases the lever arm, the base plate returns to a neutral position or "in-tune" state due to the biasing effect of springs that counteract the tension of the guitar strings attached to the bridge.

Modifications of a tremolo device are described in U.S. Pat. No. 4,171,661, U.S. Pat. No. 4,632,004, U.S. Pat. No. 4,903,568, U.S. Pat. No. 5,088,374, or U.S. Pat. No. 6,300,550, and include a base plate having two knife-shaped regions located on either side, and typically along the leading edge, of a base plate. Each knife-shaped edge region registers against a screw or pin set into the upper surface of the guitar body. The contact are between the knife shaped edge and pin is small permitting easy movement of the tremolo device when in use. However, as the contact area is small, both surfaces are subject to wear during use as the tremolo device is pivoted back and forth.

U.S. Pat. No. 6,015,945, discloses a leading edge of a base plate that is curved (a rocker element) and contacts two pins positioned on either side of a base plate, each pin has an approximate "I beam" cross section defining three contact surfaces. The three contact surfaces comprise two confining surface portions that may be planar or convex located above and below, and spaced apart by, a planar bearing surface that is oriented essentially perpendicular to the curved leading edge of the base plate. The three surfaces of the pin ensures that the contact between the curved leading edge of the base plate and the pin occurs at one (when contacting the bearing surface) or two (when contacting the bearing surface and one of the confining surfaces) contact points.

SUMMARY

The present disclosure relates to a tremolo device for a stringed instrument. More particularly, the disclosure relates to a tremolo device for a guitar.

It is an object of the invention to provide an improved tremolo device.

According to the present invention there is provided a tremolo device comprising, a base plate having a leading edge comprising a bearing surface and a bracket for attachment of a lever, and a pivot rail comprising a pivot bearing surface that matingly engages the bearing surface, and when matingly engaged, the bearing surface of the leading edge and the pivot bearing surface defines 3 or more contact surfaces having a length of from about 20% to about 100% of the length of the leading edge. The lever may be attached to the bracket. Furthermore, the leading edge may extend the length of the base plate from one side of the base plate to the opposite side.

The present invention also provides the tremolo device as defined above, wherein the bearing surface of the leading edge comprises a concave surface and the pivot bearing surface of the pivot rail comprises a convex surface.

The pivot rail of the tremolo device as described above, may comprise one or more pins that engage one or more slots, or slotted apertures, on the leading edge of the base plate. Alternatively, the pivot rail of the tremolo device may comprises one or more registration pins that engage one or more cavities within a bottom edge of the bearing surface of the leading edge.

The present invention also provides the tremolo device as described above, wherein the 3 or more contact surfaces have a length of 25% of the length of the leading edge, or the 3 or more contact surfaces have a length of about 100% of the length of the leading edge.

The present invention also pertains to the tremolo device of claim 1, wherein, one of the bearing surface of the leading edge, or the pivot bearing surface, comprises two or more flat surfaces.

The present invention provides the tremolo device as defined above, wherein the one or more than one contact surface comprises from 3 to 100 contact surfaces when viewed in cross section.

The tremolo device of the present invention may be retrofit to guitars that comprise factory-provided tremolo devices as described for example in U.S. Pat. No. 2,741,146. In this example, the pivot rail may be positioned at the fulcrum ridge and use the same holes in the guitar body for attachment to the guitar body as used by the beveled base plate in U.S. Pat. No. 2,741,146. Furthermore, the base plate as described herein may be attached to the rod in the same manner as the factor provided base plate. The tremolo device described herein may also be retrofitted to other support structure for tremolo devices as well. An advantage of the tremolo device as described herein is that since the pivot rail is attached to the guitar body, the base plate may be easily removed from the guitar to facilitate string replacement, and spring replacement if required, while at the same time provide a fluid rotational movement of the base plate about the pivot rail.

Conventional knife-edged, or curved leading edge designs of base plates are inherently problematic in that while the knife/curved-edge-pin contact area is small and minimizes friction, the force per unit area transferred across this contact surface area is great. Therefore, there is an increase in wear and possible failure of the material from which the knife/curved-edge bearing or pin surface is made. As the bearing surfaces become dulled, friction increases, leading to less than ideal performance in that the tremolo base plate does not consistently return to the precise "in-tune" position at rest. An advantage of the present invention is that the surface area between the leading-edge of the base plate and the pivot rail is significantly increased. This not only reduces wear between these two surfaces, but also enhances sound transfer. Without wishing to be bound by theory better sound transfer may arise as a result of an increase in the transfer of vibrational energy from the base plate to the pivot rail, and the surface of the guitar. Furthermore, by increasing the contact surface area between the base plate and the pivot rail, when the tremolo device of the present invention is in use, the device imparts a feel of a fixed bridge (hard tail) design, yet has the characteristics of a floating tremolo.

Even though there is an increase in the surface area between the bearing surface of the leading edge and the pivot bearing surface, it has also been observed that the movement of the base plate against the pivot rail during use is free and unhindered.

In many prior art designs that utilize a pin to register the knife or curved edge, the pin has a cleft, recessed or "I beam" shape (when viewed in cross section) to receive the knife or curved leading edge. The cleft in the pin is positioned above the surface of the guitar top, and when in place and in a neutral position, the bottom surface of the base plate typically floats above the top surface of the guitar. This configuration may lead to a neutral position that is not always in tune as the base plate may move above or below a plane parallel to the top surface of the guitar, and produce a flat sound. An advantage of the tremolo device as described herein is that when installed, the base plate, or a portion of the base plate when in a "neutral" position may lie directly on the top surface of the guitar body. This further enhances the transmission of energy from the base plate to the guitar body when in use. Also, by having the base plate lie on the top surface of the guitar body when in the "neutral" position, this ensures that the guitar is in tune when the tremolo device is not being activated. Also provided herein is a tremolo device that comprises a base plate when in a neutral position lies above the top surface of the guitar, but that registers with pins or registration pins of the pivot rail so that an in-tune neutral position is achieved.

This summary does not necessarily describe all features of the invention. Other aspects, features and advantages of the present invention will become apparent to those of ordinary skill in the art upon review of the following description of specific embodiments of the invention.

BRIEF DESCRIPTION OF THE DRAWINGS

These and other features of the invention will become more apparent from the following description in which reference is made to the appended drawings wherein:

FIG. 4A shows a top view of an example of a base plate and pivot rail of the present invention; FIG. 4B is a front view of the base plate and pivot rail shown in FIG. 4A; FIG. 4C is a top transparent view of the base plate and pivot rail shown in FIG. 4A; FIG. 4D is a bottom view of the base plate and the pivot rail shown in FIG. 4A; FIG. 4E is a cross section view of the base plate and pivot rail shown in FIG. 4B; FIG. 4F is a fragmentary cross sectional view of the front portion of the base plate and pivot rail as shown in FIG. 4E; FIG. 4G is an exploded elevation view of the base plate and pivot rail of FIG. 4A.

FIG. 5A shows a top view of an example of a base plate and pivot rail of the present invention; FIG. 5B is a front view of the base plate and pivot rail shown in FIG. 5A; FIG. 5C is a top transparent view of the base plate and pivot rail shown in FIG. 5A; FIG. 5D is a bottom view of the base plate and the pivot rail shown in FIG. 5A; FIG. 5E is a cross section view of the base plate and pivot rail shown in FIG. 5B; FIG. 5F is a fragmentary cross sectional view of the front portion of the base plate and pivot rail as shown in FIG. 5E; FIG. 5G is an exploded elevation view of the base plate and pivot rail of FIG. 5A.

FIG. 6A shows a top view of an example of a base plate and pivot rail of the present invention; FIG. 6B is a front view of the base plate and pivot rail shown in FIG. 6A; FIG. 6C is a top transparent view of the base plate and pivot rail shown in FIG. 6A; FIG. 6D is a bottom view of the base plate and the pivot rail shown in FIG. 6A; FIG. 6E is a cross section view of the base plate and pivot rail shown in FIG. 6B; FIG. 6F is a fragmentary cross sectional view of the front portion of the base plate and pivot rail as shown in FIG. 6E; FIG. 6G is an exploded elevation view of the base plate and pivot rail of FIG. 6A.

FIG. 7A shows a top view of an example of a base plate and pivot rail of the present invention; FIG. 7B is a front view of the base plate and pivot rail shown in FIG. 7A; FIG. 7C is a top transparent view of the base plate and pivot rail shown in FIG. 7A; FIG. 7D is a bottom view of the base plate and the pivot rail shown in FIG. 7A; FIG. 7E is a cross section view of the base plate and pivot rail shown in FIG. 7B; FIG. 7F is a fragmentary cross sectional view of the front portion of the base plate and pivot rail as shown in FIG. 7E; FIG. 7G is an exploded elevation view of the base plate and pivot rail of FIG. 7A.

DETAILED DESCRIPTION OF EXEMPLARY EMBODIMENTS

The present disclosure relates to a tremolo device for a stringed instrument. More particularly, the disclosure relates to a tremolo device for a guitar.

The following description is of a preferred embodiment.

Directional terms such as "top", "bottom", "left", "right", "horizontal", "vertical", "transverse" and "longitudinal" are used in this description merely to assist the reader to understand the described embodiments and are not to be construed to limit the orientation of any described method, product, apparatus or parts thereof, whether in operation or in connection to another object.

Figure 1:
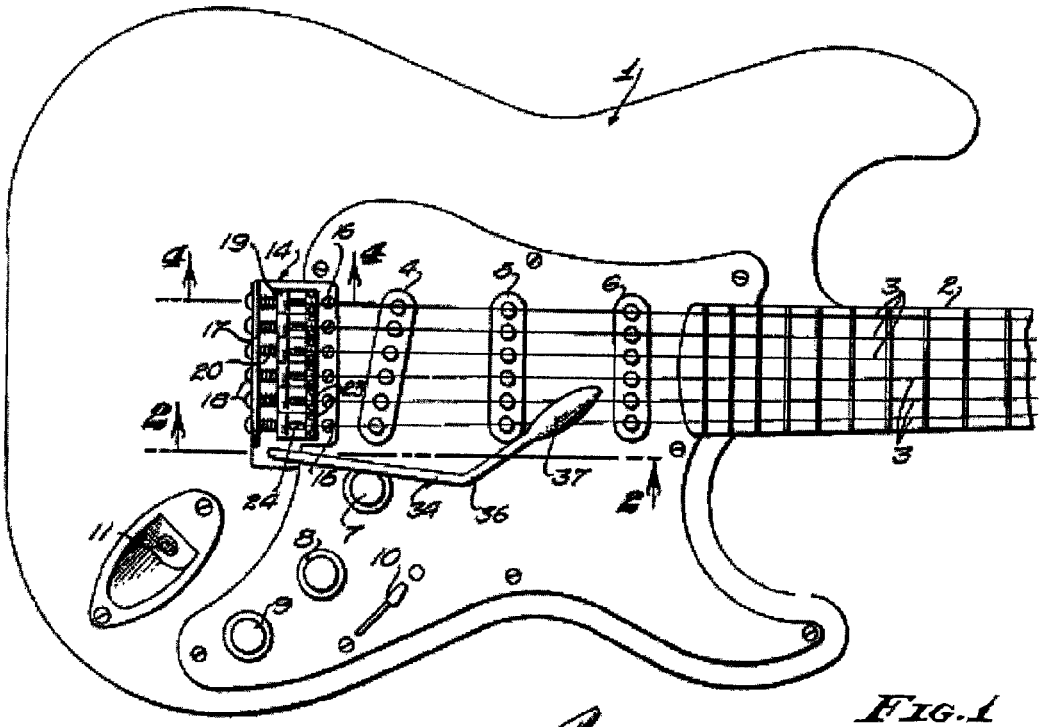
FIG. 1 is prior art and shows a fragmentary top view of a guitar.
Figure 2:
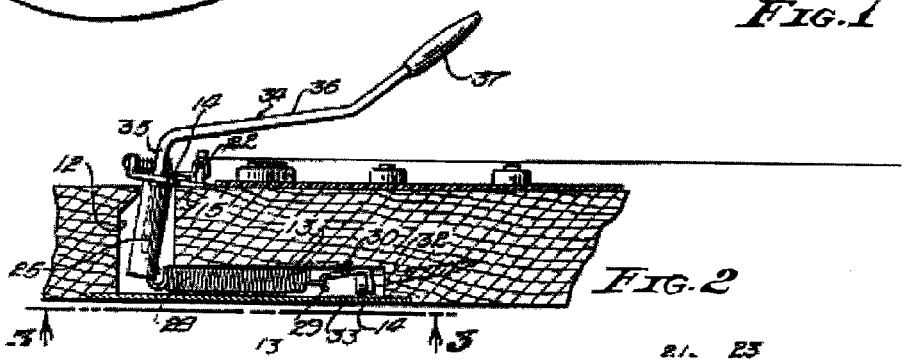
FIG. 2 Prior Art
FIG. 2 is prior art and shows a sectional view along 2-2 of FIG. 1.

FIGS. 1 and 2 show a prior art (U.S. Pat. No. 2,741,146) example of a tremolo device for use with a guitar. The tremolo comprises a base plate (noted as 14 in FIGS. 1 and 2) attached to a bar (noted as 25 in FIG. 2) that extends within a cavity (noted as 12 in FIG. 2) in the body of the guitar. The bar is attached at its lower end to one or more springs (28 in FIG. 2) to an anchor the bar within the cavity (32, FIG. 2). A leading edge of the base plate is beveled to form a fulcrum ridge (15, FIG. 2), and the plate is loosely attached to the guitar body using a plurality of screws linearly disposed (16, FIG. 1) along the fulcrum ridge. With this arrangement, the base plate may pivot about the fulcrum ridge defined by the screws. A lever arm (34, FIGS. 1 and 2) to actuate the tremolo device is attached to one side of the base plate.

Figure 3A:
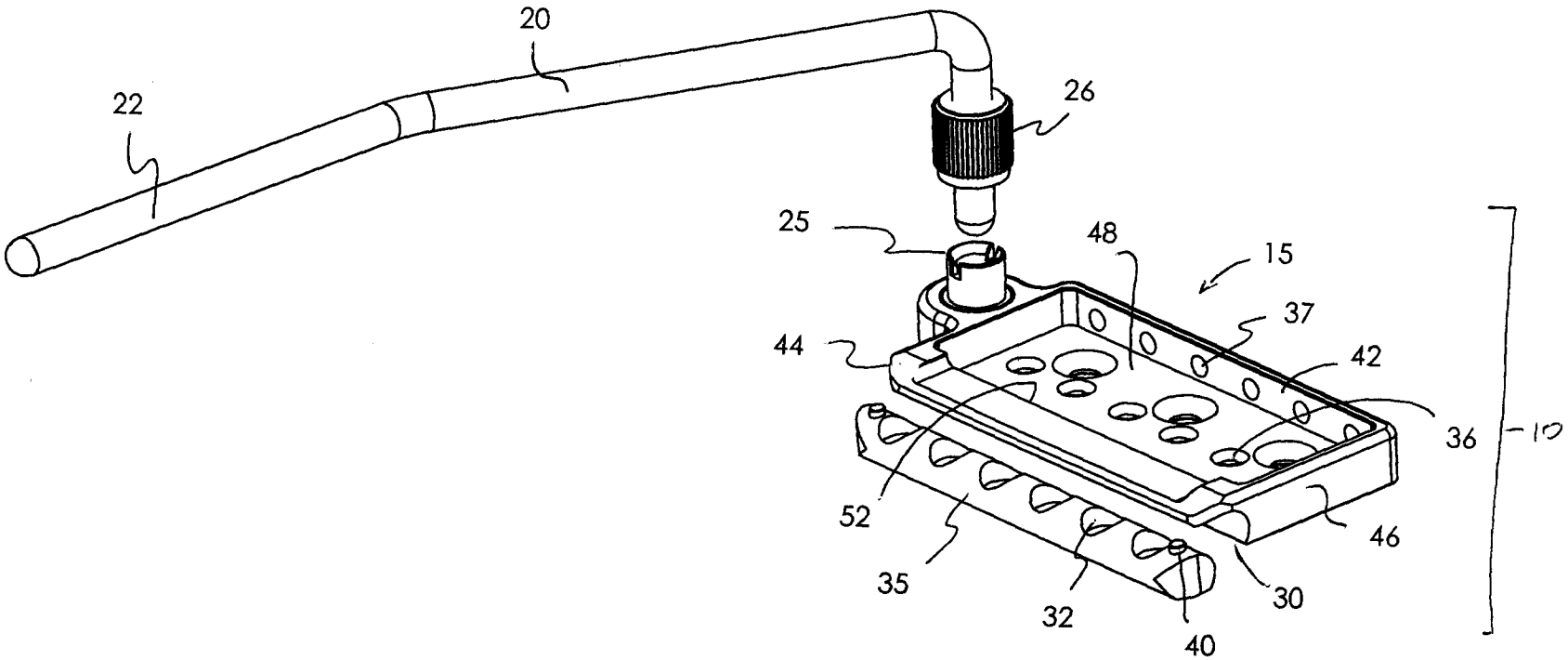
FIG. 3A shows an exploded perspective view of an example of a tremolo device comprising a base plate, pivot bar and lever.

With reference to FIG. 3A, an example of a tremolo device of the present invention is provided. The tremolo device 10 comprises a base plate 15 with a leading edge 30 defining a bearing surface that is engagable with a pivot rail 35 having an outer bearing surface (pivot bearing surface). The pivot rail 35 may be mounted to the upper surface of guitar using screws or other fasteners via holes 32. A lever 20 may be attached to one side of the base plate 15 by bracket 25, and when attached, is employed to rotate the base plate 15 about the pivot bar 35, and alter the tension on the strings and provide tremolo effects.

The present invention generally provides a tremolo device comprising, a. a base plate having a leading edge comprising a bearing surface and a bracket for attachment of a lever, and
b. a pivot rail comprising a pivot bearing surface that matingly engages the bearing surface.

As described in more detail below, when the bearing surface of the leading edge and the pivot bearing surface are matingly engaged, 3 or more contact surfaces having a length of from about 20% to about 100% of the length of the leading edge are defined.

The bearing surface of leading edge 30 of the base plate 15 engages with the bearing surface of the pivot rail 35 over a length that may extend for the full length of the leading edge, as shown in FIGS. 4A-G to 6A-G, or a portion of the length of the leading edge, for example as shown in FIG. 7A-G. Without wishing to be bound by theory, the increased length between the bearing surfaces of the leading edge and pivot rail reduces the force per unit area between these two surfaces when in use, decreasing wear, and maximizing the transmission of vibrational energy, and sound transfer, from the bridge (located on the base plate when in use) to the guitar body through the pivot rail, when compared to prior art configurations that use a leading edge with two knife-shaped, or curved regions, engaging two pins, as shown in U.S. Pat. No. 4,171,661, U.S. Pat. No. 4,903,568, U.S. Pat. No. 5,088,374, U.S. Pat. No. 615,945, and U.S. Pat. No. 6,300,550.

Figure 3C:
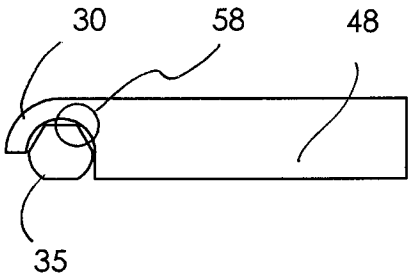
FIG. 3C shows a cross section view of the base plate and pivot rail, the bearing surface of the leading edge of the base plate having a smooth concave surface, and the pivot bearing surface having a generally convex surface with three flat surfaces defining 4 contact surfaces with the bearing surface of the leading edge.
Figure 3D:
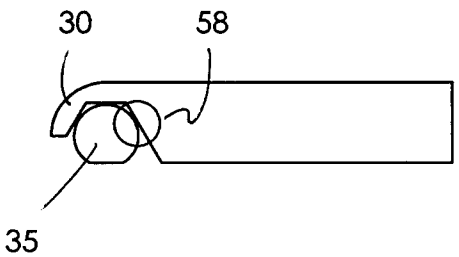
FIG. 3D shows a cross section view of the base plate and pivot rail, the bearing surface of the leading edge of the base plate having a generally concave surface with three flat surfaces, and the pivot bearing surface having a smooth concave surface, defining three contact surfaces with the bearing surface of the leading edge.
Figure 3B:
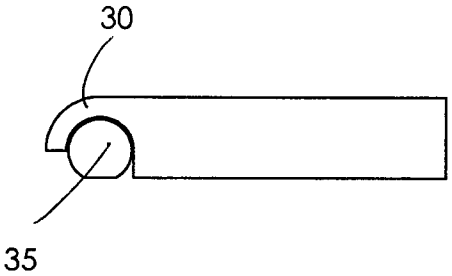
FIG. 3B shows a cross section view of the base plate and pivot rail, the bearing surface of the leading edge of the base plate having a smooth concave surface, and the pivot bearing surface having a smooth concave surface.

The bearing surface of the leading edge 30 or the pivot rail 35, or both the leading edge and the pivot rail, may have curved surface when viewed in cross section that matingly engage, and permit a rotational movement of the base plate about the pivot rail (FIG. 3B). However, it is also contemplated that either the leading edge 30, or pivot rail 35, may comprise a bearing surface that is not curved in cross section, but may comprises three or more contact surfaces 58 when viewed in cross section (FIGS. 3C and D), and that may extend along a portion, or the full length, of the bearing surface. In this way the surface area between the leading edge 30 and the pivot rail 35 may be reduced while still maintaining contact between the leading edge and pivot rail along a portion of the length, or along the full length, of the bearing surfaces thereby maintaining advantages of the present invention in reducing wear between the two bearing surfaces and ensuring efficient vibrational energy transfer (sound transfer) from the bridge and base plate, to the pivot rail and guitar body. However, by using a curved surface on both the leading edge 30 and pivot rail 35, the contact area between these two bearing surfaces is maximized and reduced wear of the bearing surfaces, and increased energy transmission is achieved.

By matingly engaged is meant that the contact between the bearing surface of the pivot rail 35 (the pivot bearing surface) and the bearing surface of the leading edge 30 occurs along three or more contact surfaces when viewed in cross section (e.g. 58; FIGS. 3C and 3D), for example 3, 4, 5, 6, 7, 8, 9, 10, 15, 20, 25, 30, 40, 50, 75, 100, or any amount therebetween, contact surfaces, and that the contact surfaces extend along a portion, or the full length of the bearing surfaces of the pivot rail 35 or the leading edge 30. For example, the length of the three or more contact surfaces between the bearing surface of the leading edge and pivot rail may extend from about 20% to about 100%, or any amount therebetween of the length of the leading edge, or from about 20, 22, 24, 25, 26, 28, 30, 32, 34, 36, 38, 40, 42, 44, 46, 48, 50, 52, 54, 56, 68, 60, 62, 64, 66, 68, 70, 72, 74, 75, 76, 78, 80, 82, 84, 86, 88, 90, 92, 94, 96, 98, 100%, or any amount therebetween of the leading edge. For example the contact surface may extend for 25% of the length of the leading edge (FIG. 7A-G), or the contact surface may extend for about 100% of the length of the leading edge (FIGS. 4A-G to 6A-G). The bearing surface of the leading edge may also comprise a concave surface and the pivot bearing surface of the pivot rail comprises a convex surface (e.g. FIGS. 3A and 3B).

By leading edge, it is meant the edge of the base plate that extends the length of the base plate, typically from one side of the base plate to the opposite side (44, 46), and that is configured to engage the pivot rail. As noted above, the bearing surface of the leading edge may comprise a portion of the length of the leading edge, for example as shown in FIG. 7G.

Base plate 15 as described herein, may be mounted as described for example in U.S. Pat. No. 2,741,146 (which is incorporated herein by reference) to a bar (noted as 25 in FIG. 2) or like device, via one or more attachments holes 34. Strings may be attached to the guitar in a conventional manner by passing through holes 36 in the base plate. As shown in FIG. 2, the bottom end of the bar may be connected to an anchor (noted as 32 in FIG. 2) via one or more springs (noted as 28 in FIG. 2). When in use, and with the base plate 15, pivot rail 35, and strings fitted to the guitar, the bearing surface of the pivot rail 35 resists forces applied to the base plate 15 that arise from the tensioned guitar strings (noted as 3 in FIG. 1) and at least one spring (noted as 28 in FIG. 2). The springs attached to the bottom end of bar counteract the tension of the strings to retain the base plate in a playing, or "in-tune' position when in a neutral (unactuated) position. However, it is to be understood that the base plate and pivot rail as described herein may be attached to other analogous mechanisms (for example as described in U.S. Pat. No. 4,171,661, U.S. Pat. No. 4,903,568, U.S. Pat. No. 4,984,493, U.S. Pat. No. 5,088,374, U.S. Pat. No. 6,015,945, U.S. Pat. No. 6,300,550 which are incorporated herein by reference) that can be retrofitted as required, to permit movement of the base plate about the pivot rail as described herein, and result in a tremolo effect when in use.

A tremolo effect is achieved by pivoting or rocking the base plate 15 about the pivot rail 35 by actuation of the lever 20 attached to the base plate by bracket 25. When the base plate 15 rotates forward about a fulcrum having a center of axis defined by the pivot rail 35, this causes the strings to reduce in tension, while at the same time stretching the one or more spring (noted as 28 in FIG. 2). The base plate 15 returns to the neutral or "in tune" position through the counteraction of the one or more spring (note as 28 in FIG. 2).

Figure 7:
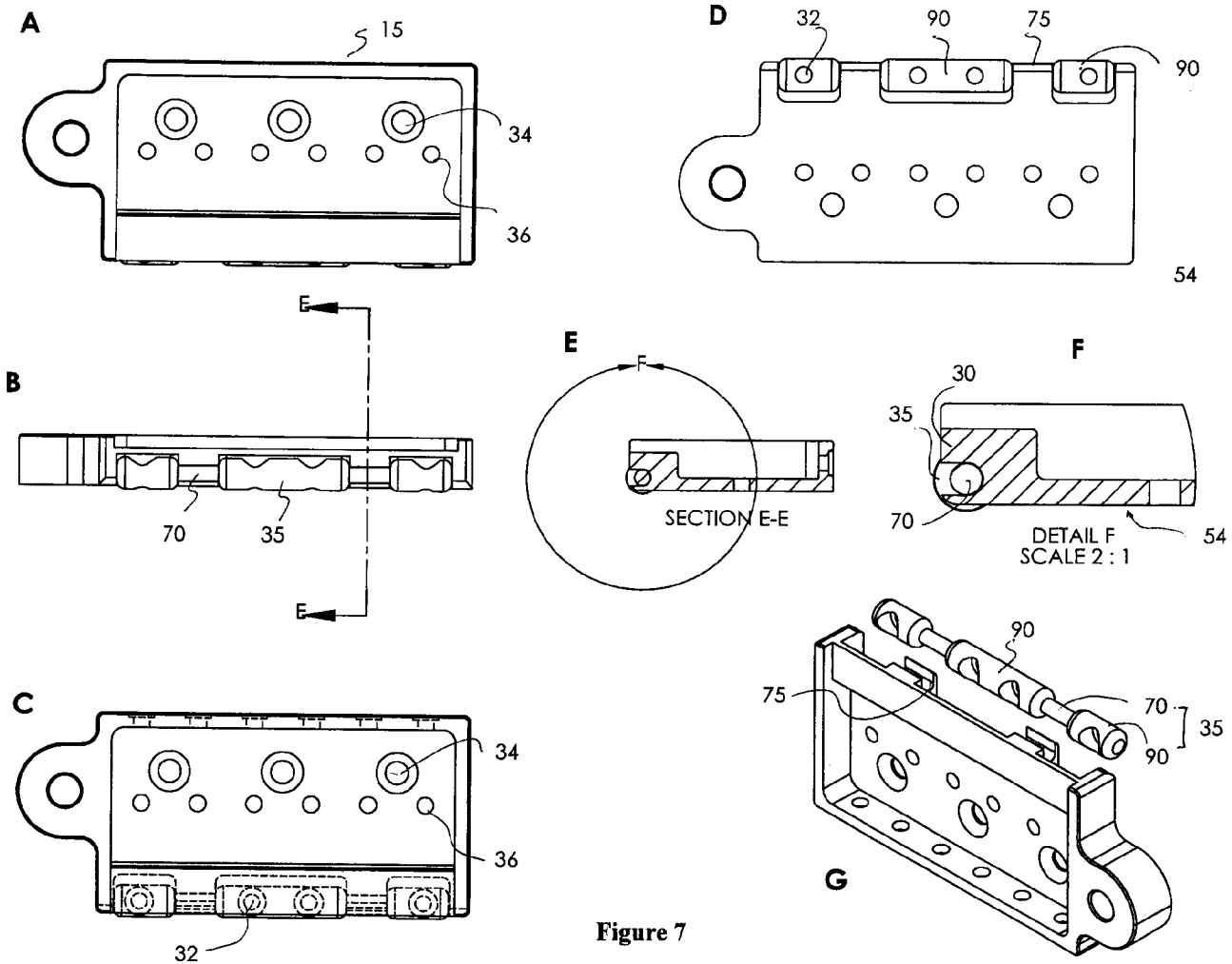
FIG. 7 shows various views of an alternate example of a base plate with pivot rail of the present invention.

As shown in FIG. 7G, the pivot rail may comprise one or more rod-like sections 70 that matingly engage one or more corresponding bearing surfaces of portions of the leading edge 75. These rod-like sections 70 are disposed between attachment portions (90) of the pivot rail 35 that are used to attach the pivot rail 35 to the guitar body (not shown) via holes 32.

FIG. 3A depicts an example of the tremolo device that has a base plate 15 comprising a bearing surface along a leading edge 30 that matingly engages a pivot rail 35. The pivot rail 35 comprises holes 32 for attachment to a top surface of a guitar. The base plate has a leading edge 30 and a back end 42, opposed sides 44 and 46, and a bottom surface 48. The sides 44, 46, and back 42 ends and inside surface 52 of the leading edge 30 of the base plate are raised to form side, back and front walls, respectively. Strings, when installed on the guitar pass through apertures 36 provided in the bottom surface of the base plate 15. Holes 37 may be used to fit conventional adjusters connected to the bridge. A lever 20 may be mounted to a bracket 25 that is disposed at one of the side 44 of the base plate 15. The lever may be mounted to the bracket for example by threading the lever 20, or a coupler 26 fitted to the lever 20, to a correspondingly threaded bracket 25, or the lever 20, or coupler 26, may have one or more pins that engage with a bracket having one or more slots or recess to engage the pins, thereby permitting removal of the lever. Alternatively the lever may be fixed and comprise an integral part of the base plate 15. The lever 20 is attached so that in use the arm 22 projects upward and away from the guitar body.

Figure 4:
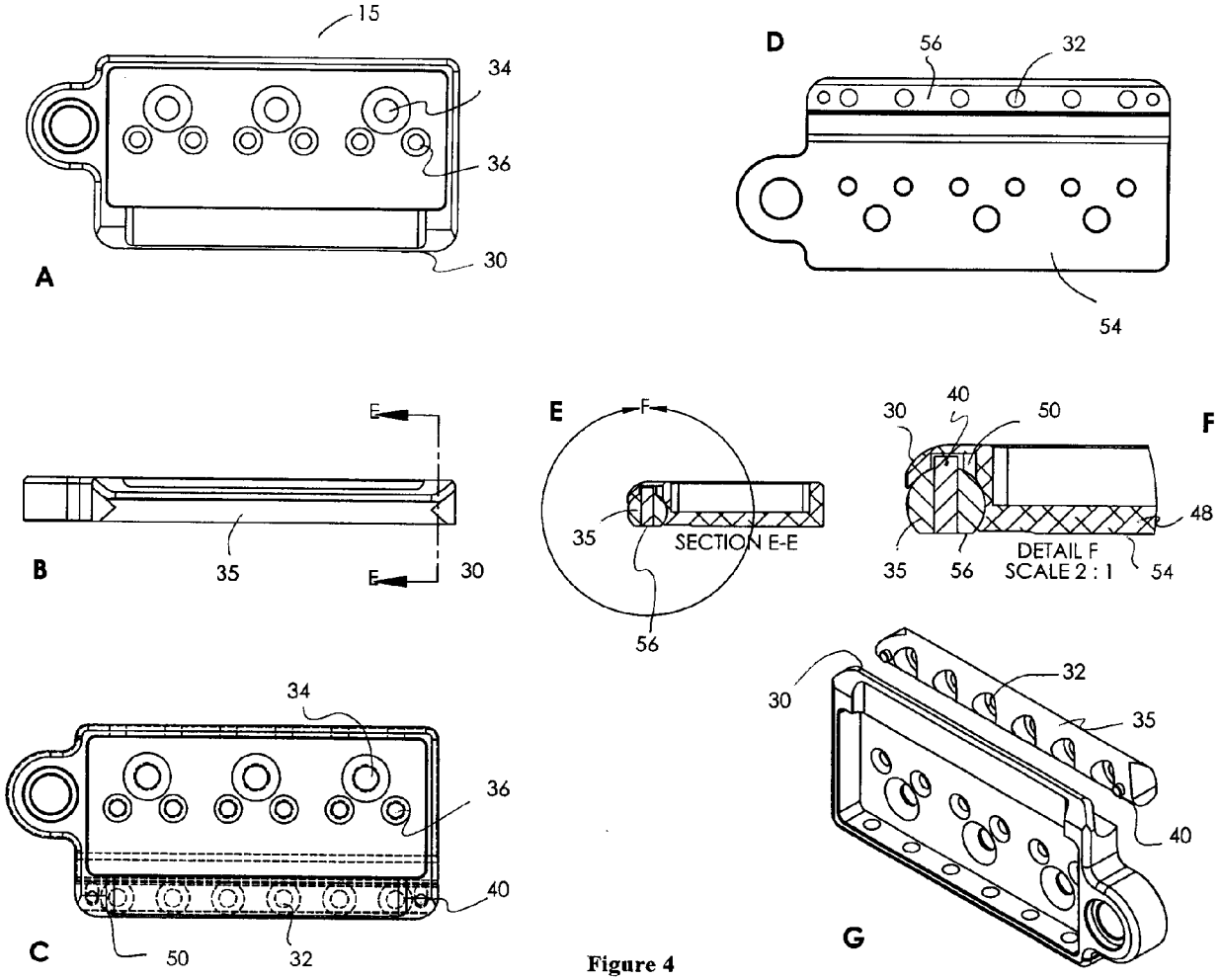
FIG. 4 shows various views of an alternate example of a base plate with pivot rail of the present invention.

Referring to FIGS. 4A to G an example of a tremolo device is shown. The bearing surface 30 of the base plate 15 and the pivot rail 35 are engaged in FIGS. 4A-F, and shown apart in FIG. 4G. With reference to FIGS. 4E and F, it can be seen that the pivot rail 35 may comprises a flat bottom surface 56 (FIGS. 4D, E) so that it sits flush when attached to the top surface of a guitar (not shown) via holes 32. However, the pivot rail may also be circular in cross section and attached to the guitar surface using holes 32. The tremolo device in FIGS. 4E and F is shown in a "neutral" position or "in-tune" position, and if fitted on a guitar, the outside bottom surface 54 of the base plate would lie against the top surface of the guitar body (not shown). In neutral position the tension between the guitar strings and the one or more counterbalancing spring (noted as 28 in FIG. 2) are in equilibrium. Without being bound by theory, when the base plate lies flat on the top surface of the guitar, there is an increased surface area between the base plate and the guitar body increasing the transmission of energy from the strings to the guitar body.

Movement of base plate 15 may be limited in both a rotational direction, when moved about pivot rail 35, and axially, along the length of the pivot rail, due to provision of pins 40 located near the end of the pivot rail 35 that register within slots 50 (see FIGS. 4C and F) correspondingly located at either end, and within the bearing surface, of the leading edge 30. Slots 50 are positioned perpendicular to the length of the leading edge, and are of a length that permits rotational movement of the base plate, when engaged with the pivot rail. In the example of a tremolo device shown in FIGS. 4F and G, the slots are recesses within the bearing surface of the leading edge 30. The registration of pins 40 within slots 50 limits axial movement of base plate along the length of the pivot rail 35, yet allows limited rotational motion of the base plate with respect to the pivot rail when the tremolo device is operated. It is to be understood that if desired, the pins may be positioned on the bearing surface of the leading edge 30 of the base plate and that complementary slots located in the pivot rail.

Referring now to FIGS. 5A to G, there is shown a tremolo device that comprises a pivot rail 35 with pins 40 similar to that shown in FIG. 4A-G, that matingly engages the leading edge 30 of base plate 15. In this example, slotted apertures 45 pass though the thickness of the leading edge. The slotted apertures are located at either end of the leading edge to receive pins 40, and are positioned perpendicular to the length of the leading edge. The slotted apertures 45 are of a length that permits rotational movement of the base plate, when engaged with the pivot rail.

Also shown in FIGS. 5C-F, is that a portion of the outside bottom surface 54 of the base plate 15 may be reduced in thickness to reduce weight of the base plate if desired, thereby forming ridge 55 that lies against the top surface of the guitar when the tremolo device is installed on a guitar (not shown).

Figure 6:
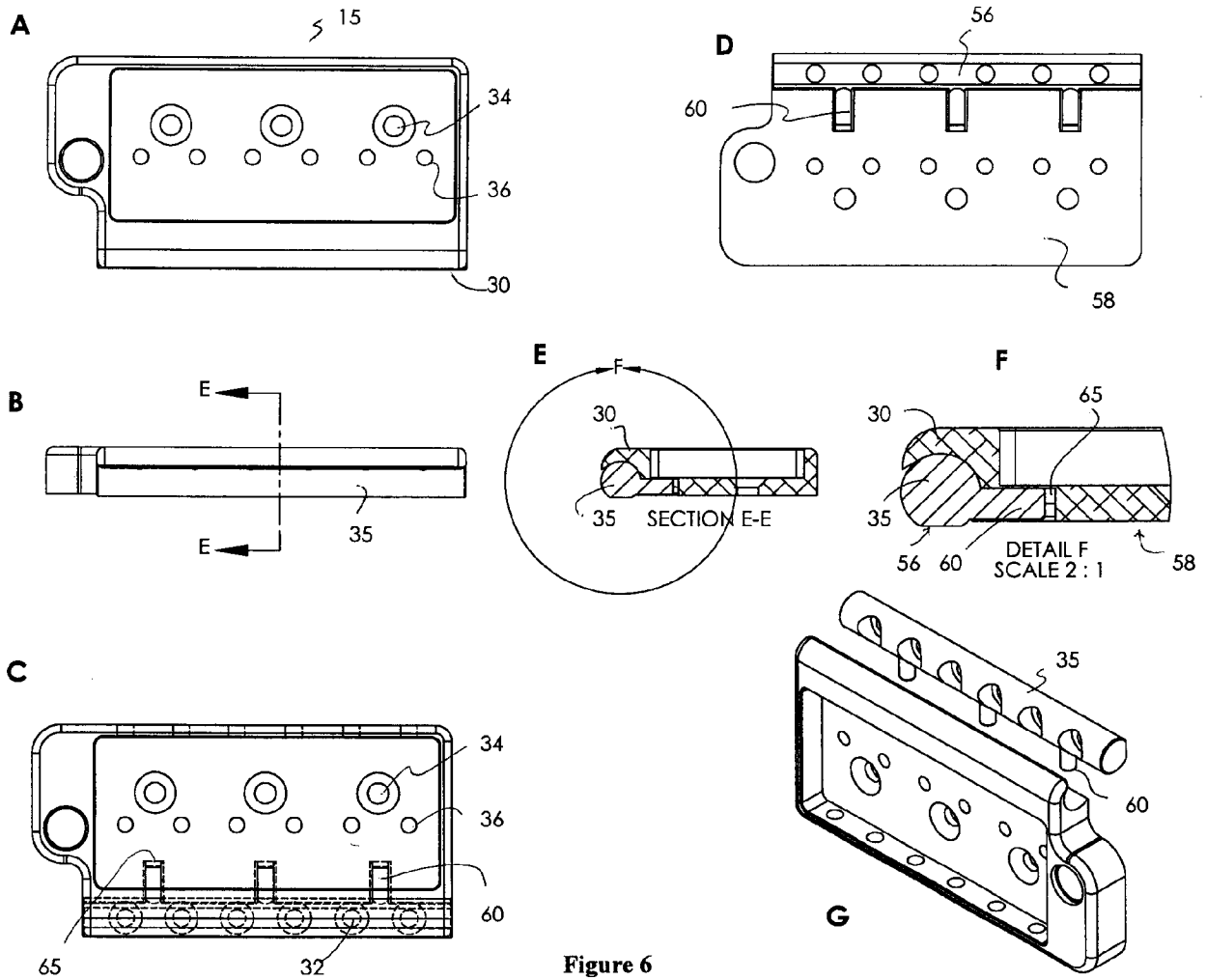
FIG. 6 shows various views of an alternate example of a base plate with pivot rail of the present invention.

Referring to FIGS. 6A to 4G, there is shown an alternate tremolo device. The tremolo device is similar to that as described previously, comprising a pivot rail 35, that matingly engages the bearing surface of leading edge 30 of base plate 15. In this example the pivot rail comprises one or more registration pins 60. Registration pins 60 fit into complementary cavities 65 positioned along the bottom edge of the bearing surface 30. When the pivot rail 35 and base plate 15 are fitted the guitar, the registration pins 60 limit axial movement of the base plate 15 along the length of the pivot rail 35, by registering with cavities 65. In a neutral position (FIGS. 6E and F), the registration pins 60 lay flush against the base plate 15, within cavities 65, and ensure that the base plate is in an in-tune position.

Figure 5:
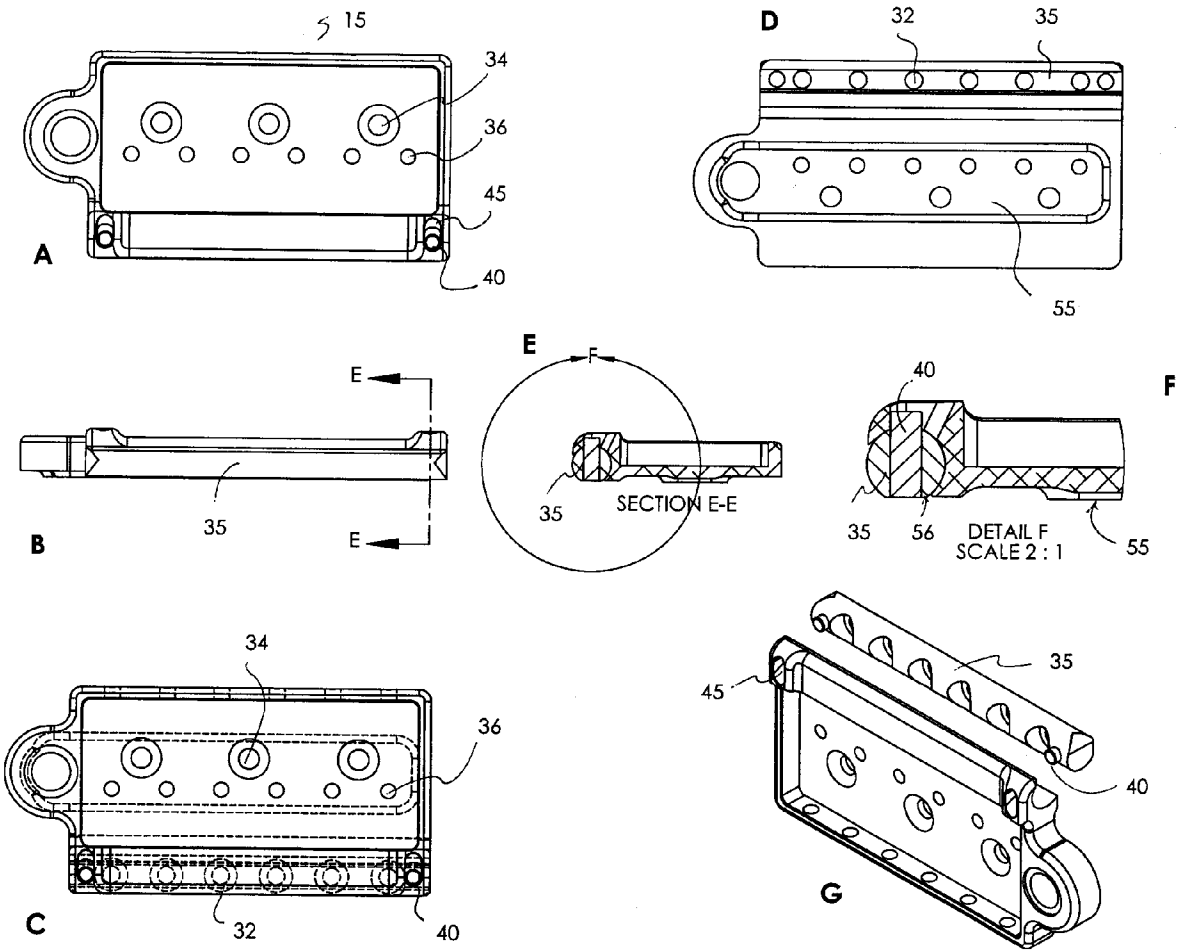
FIG. 5 shows various views of an example of a base plate with pivot rail shown in FIG. 3.

Referring to FIGS. 7A to 5G, there is shown another variant of a tremolo device. This tremolo device comprises a pivot rail 35 with one or more rod-like sections 70 positioned between attachment portions 90 of the pivot rail 35. The rod-like sections 70 have a diameter that is smaller then the thickness of the attachment portions 90 of the pivot rail 35. The rod-like sections matingly engage portions of the leading edge 75. When fitted together, base plate 15 pivots around the axis of the rod-like segments 70 of the pivot rail 35. Axial movement of the base plate along the length of the pivot rail 35 is limited by either the portions of the leading edge 75 abutting the attachment portions 90 of the pivot rail 35, or the ends of the pivot rail 35 abutting side walls 85.

While several variants has been described in the foregoing, it is to be understood that other variations that comprise a pivot rail matingly engage a leading edge of a base plate are possible. It will be clear to any person skilled in the art that modifications of and adjustments to the foregoing embodiments, not shown, are possible.

All citations are herein incorporated by reference, as if each individual publication was specifically and individually indicated to be incorporated by reference herein and as though it were fully set forth herein. Citation of references herein is not to be construed nor considered as an admission that such references are prior art to the present invention.

The invention claimed is:

1. A tremolo device comprising, a base plate having a leading edge comprising a bearing surface and a bracket for attachment of a lever, and a pivot rail comprising a pivot bearing surface that matingly engages the bearing surface and, when matingly engaged, the bearing surface of the leading edge and the pivot bearing surface defines 3 or more contact surfaces having a length of from about 20% to about 100% of the length of the leading edge.

2. The tremolo device of claim 1, wherein the bearing surface of the leading edge comprises a concave surface and the pivot bearing surface of the pivot rail comprises a convex surface.

3. The tremolo device of claim 1, wherein the pivot rail comprises one or more pins that engage one or more slots on the leading edge of the base plate.

4. The tremolo device of claim 2, wherein the pivot rail comprises one or more pins that engage one or more slots on the leading edge of the base plate.

5. The tremolo device of claim 1, wherein the pivot rail comprises one or more pins that engage one or more slotted apertures on the leading edge of the base plate.

6. The tremolo device of claim 2, wherein the pivot rail comprises one or more pins that engage one or more slotted apertures on the leading edge of the base plate.

7. The tremolo device of claim 1, wherein the pivot rail comprises one or more registration pins that engage one or more cavities within a bottom edge of the bearing surface of the leading edge.

8. The tremolo device of claim 2, wherein the pivot rail comprises one or more registration pins that engage one or more cavities within a bottom edge of the bearing surface of the leading edge.

9. The tremolo device of claim 1, wherein the 3 or more contact surfaces have a length of 25% of the length of the leading edge.

10. The tremolo device of claim 2, wherein the 3 or more contact surfaces have a length of 25% of the length of the leading edge.

11. The tremolo device of claim 1, wherein the 3 or more contact surfaces have a length of about 100% of the length of the leading edge.

12. The tremolo device of claim 2, wherein the 3 or more contact surfaces have a length of about 100% of the length of the leading edge.

13. The tremolo device of claim 1, wherein, one of the bearing surface of the leading edge or the pivot bearing surface comprises two or more flat surfaces.

14. The tremolo device of claim 3, wherein the one or more than one contact surface comprises from 3 to 100 contact surfaces when viewed in cross section.

15. The tremolo device of claim 1, wherein the lever is attached to the bracket.

* * * * *